United States Patent [19]

Feldinger

[11] Patent Number: 5,035,222

[45] Date of Patent: Jul. 30, 1991

[54] SYSTEM FOR CORRECTING THE COMPOSITION OF FUEL-AIR MIXTURE UPON A CHANGE IN THE STATE OF LOADING OF AN INTERNAL COMBUSTION ENGINE

[75] Inventor: Martin Feldinger, Königstein, Fed. Rep. of Germany

[73] Assignee: VDO Adolf Schindling AG, Frankfurt am Main, Fed. Rep. of Germany

[21] Appl. No.: 444,770

[22] Filed: Dec. 1, 1989

[30] Foreign Application Priority Data

Jan. 26, 1989 [DE] Fed. Rep. of Germany ..... 3902284

[51] Int. Cl.[5] ..... F02M 37/04

[52] U.S. Cl. ..... 123/452; 261/51; 261/DIG. 56; 123/454; 123/337

[58] Field of Search ..... 123/452, 453, 454, 455, 123/337; 261/DIG. 56, DIG. 29, DIG. 78, 50 A, 116, 51

[56] References Cited

U.S. PATENT DOCUMENTS

| | | | |
|---|---|---|---|
| 2,964,303 | 12/1960 | Smith | 261/51 |
| 3,953,548 | 4/1976 | Knapp | 261/DIG. 56 |
| 4,087,493 | 5/1978 | Petermann | 261/44 D |
| 4,152,375 | 5/1979 | Müller | 123/452 |
| 4,187,805 | 2/1980 | Abbey | 261/DIG. 56 |
| 4,206,158 | 6/1980 | Wood | 261/DIG. 56 |
| 4,228,777 | 10/1980 | Haase | 123/452 |
| 4,359,031 | 11/1982 | Stoltman | 123/453 |
| 4,373,490 | 2/1983 | Kimata | 123/452 |
| 4,515,128 | 5/1985 | Jaggle | 123/454 |
| 4,549,515 | 10/1985 | Maisch | 123/455 |

FOREIGN PATENT DOCUMENTS

| | | | |
|---|---|---|---|
| 2828404 | 1/1979 | Fed. Rep. of Germany | 123/455 |
| 2831053 | 2/1979 | Fed. Rep. of Germany | 123/454 |

*Primary Examiner*—Carl Stuart Miller

*Attorney, Agent, or Firm*—Martin A. Farber

[57] ABSTRACT

A system with which a correction of the fuel composition upon a change in the state of load of an internal combustion engine with which a mixture-forming device (4, 6, 8, 9, 11) is associated is constructed in structurally simple manner. The mixture-forming device has a feed unit (6) for the fuel with an inlet-side fuel conveyor line (5) and a discharge-side fuel conveyor line (7) and a movably mounted feed member (18). Depending on the position of the feed member (18), the feed member (18) provides variable fuel passage cross-sections in the feed unit (6). The feed unit is connected via an opening (31) which is closed in sealing fashion by a movable equalization element (33), the equalization space (32) being connected via a branch line (34) to the discharge-side fuel conveyor line. The feed member and the equalization element are coupled with each other locked for movement in such a manner that a movement of the feed member in the direction of an enlarged fuel passage cross-section leads to a movement of the equalization element which reduces the equalization space. A movement of the feed member in the direction of a reduced fuel passage cross-section leads to a movement of the equalization element which enlarges the equalization space.

10 Claims, 2 Drawing Sheets

SYSTEM FOR CORRECTING THE COMPOSITION OF FUEL-AIR MIXTURE UPON A CHANGE IN THE STATE OF LOADING OF AN INTERNAL COMBUSTION ENGINE

FIELD AND BACKGROUND OF THE INVENTION

The present invention relates to a device for correcting a composition of fuel-air mixture upon a change in the state of load of an internal combustion engine with which a mixture-forming device is associated.

In gasoline-operated internal-combustion engines the composition of the fuel-air mixture (lambda value) must be maintained—independently of the operating point of the engine at the time—within narrow limits in order to obtain operation which is low in injurious substances. Only in this way is it possible to comply with the legally permitted limit values for pollutants in the exhaust gas of the engine. Particularly when the engine is operating with exhaust-gas catalysts, the "lambda window" should vary only very slightly around an optimal lambda value for optimal conversion of the composition of the mixture. This is obtained customarily by:

A pre-control of the fuel-air mixture for the entire operating range of the engine which differs from the very start only as little as possible from the ideal mixture composition and in practice is effected as a general rule by the calling up of specific data of engine-performance characteristics determined by tests;

An additional control regulation of the precontrolled mixture by means of a lambda probe which effects a return to the ideal lambda value in the event of deviations of the composition of the mixture from the ideal value.

The less the lambda value of the pre-controlled mixture differs from the ideal lambda value, the more effective the control of the fuel-air mixture by the lambda probe can be carried out in order to reduce fuel pollutants contained in the exhaust gas.

Upon the operation of an internal-combustion engine, it can be noted upon every change of the state of load that the air pressure varies in the inlet pipe. In this way:

Upon a reduction of the pressure in the inlet pipe, fuel which has deposited on the wall of the inlet pipe in the form of a film of fuel is evaporated and the fuel/air mixture behind the mixture-forming device is make richer, i.e. the lambda value is reduced;

Upon an increase in the pressure in the inlet pipe, fuel is precipitated on the inlet pipe and thus the mixture entering the engine becomes leaner, i.e. the lambda value increases.

In both of these cases, the fuel/air mixture fed the engine differs to a greater or lesser extent from the lambda value necessary for the optimal conversion. The faster the change in the load on the engine takes place, the greater the deviation from the optimal lambda value will be. The change in the pressure of the inlet pipe takes place upon changes in load of the engine, in particular, by change in position of the control member which regulates the amount of mixture, for instance a throttle valve, a throttle cone, etc.

In one known mixture-forming device, the resultant fuel/air mixture which is produced in the mixture-forming member which is arranged centrally on the inlet pipe differs only slightly from the ideal composition even without control. By a variable wetting of the inlet pipe, particularly in the case of rapid changes in load, a mixture which deviates from the ideal mixture is, however, fed to the engine and the quality of the exhaust gas is thus impaired. The faster the inlet-pipe pressure changes upon change in load of the engine, the less it is possible, by control via the lambda probe, to adjust these deviations from the ideal lambda value to the lambda value necessary for optimal conversion.

SUMMARY OF THE INVENTION

It is an object to the present invention to create a device by which a correction of a composition of the mixture upon a change in the state of loading of the internalcombustion engine is possible in structurally simple fashion.

According to the invention, a system for correcting the composition of the mixture upon a change in the state of load of an internal-combustion engine, in which a mixture-forming device is associated, is characterized by the fact that the mixture-forming device (4, 6, 8, 9, 11) has a feed unit (6) for the fuel with an inlet-side fuel feed line (5) and an outlet-side fuel delivery line (7) and a movably mounted feed member (18). The movably mounted feed member (18) as a function of position presents variable fuel passage crosssections in the feed unit (6), and is arranged in the feed device (6). The feed device (6) is connected via an opening (31) which is closed in sealing manner by a movable equalization element (33) to an equalization space (32) which, in turn, is connected via a branch line (34) with the outlet-side fuel delivery line (7). The feed member (18) and the equalization element (33) are coupled locked for movement with each other in such a manner that a movement of the feed member (18) in the direction towards an enlarged fuel passage cross-section leads to a movement of the equalization element (33) which reduces the equalization space (32), and a movement of the feed member (18) in the direction of a reduced fuel passage cross-section leads to a movement of the equalization member (33) which enlarges the equalization space (32).

If, therefore, the control member which regulates the amount of mixture, and which is associated with the mixture-forming device, moves in the direction of a reduction in the throughput of air, then the pressure in the inlet pipe drops. The feed member arranged in the feed unit moves simultaneously with the control member in the direction of a reduction in the fuel. The compensation element moves together with the feed member and, via the branch line which functions as by-pass line, draws fuel in between feed element and control member.

Upon a proper dimensioning of the compensation element, i.e. one which is dependent on the type of engine in question, as much fuel is thereby drawn off as is fed to the mixture by the evaporation from the walls of the inlet pipe before entrance into the engine. The fuel-air mixture fed to the engine therefore changes only slightly. However, if the control member in the mixture-forming device which controls the amount of mixture moves in the direction of an increase in the air throughput, then the pressure in the inlet pipe increases. The feed member moves simultaneously in the direction of an increase in fuel. Together with the feed member, the compensation member moves, and via the branch line, in addition, conveys fuel into the line between feed element and control member. This additionally fed fuel is substantially used for adding fuel to the wall of the inlet pipe and thus to the thickening of the film of fuel.

In this way, in its turn, the fuel/air mixture fed to the engine changes only slightly.

In accordance with the invention, the influence of the amount of fuel which is variable upon change of the inlet-pipe pressure is thus substantially compensated for by the fact that:

Upon a decrease in the pressure of the inlet pipe, i.e. the evaporation of fuel from the walls of the inlet pipe, the mixture supplied by the mixture-forming device is made leaner;

Upon increase in the pressure of the inlet pipe, i.e. in condensation of fuel from the mixture supplied from the mixture formation and depositing on the inlet-pipe walls, the mixture supplied by the mixture-forming device is enriched.

In both the said cases, if the equalization element is properly dimensioned, the difference from the fuel/air mixture which is ideally pre-controlled by the mixture-forming device is upon sudden change of load reduced so that the control is relieved by the lambda probe. In the final result, the conversion of the pollutants upon changes in load is thereby improved.

In accordance with a special embodiment of the invention, the equalization element (33) is developed as equalization piston (33) which passes tightly through the opening (31). In order to obtain the effect in accordance with the invention, however, a membrane, a folded bellows, or the like can also be used instead of a piston.

The feed member (18) and the equalization element (33) preferably form a single structural unit. The feed unit (6) is advisedly subdivided into two partial spaces (16, 17) by a diaphragm (15) having an opening (14), one partial space (16) being connected to the feed-side fuel and air line (5) and the other partial space (17) being connected to the discharge-side fuel feed line (7). Fuel-air mixture flow is dependent on the position of the feed member (18) for passing to a greater or lesser extent through the diaphragm opening, and the partial space (16) associated with the feed-side fuel. Air line (5) is connected to the equalization space (32).

The feed member (18) is advisedly developed as a cone and connected in movement locked fashion with a control member developed as throttle element (11) having symmetry of revolution, and which is displaceable in a nozzle body (10) of symmetry of revolution and forms with the latter a convergent-divergent nozzle (9). The nozzle (9) opens into the inlet pipe (13) of the internal-combustion engine, the discharge-side fuel feed line debouching into the nozzle (9) in or near to the narrowest cross-section (12). By this further development of the device in accordance with the invention, assurance is had that the movements of feed member, control member and equalization element are coupled to allow construction of this region of the mixture-forming device compactly and arranging it in the direct vicinity of the place of injection of the fuel.

Further features of the invention are described in the description of the figures.

BRIEF DESCRIPTION OF THE DRAWINGS

With the above and other objects and advantages in view, the present invention has become more clearly understood in connection with the detailed description of a preferred embodiment, when considered with the accompanying drawings, of which.

DETAILED DESCRIPTION OF THE PREFERRED EMBODIMENT

Figure 1:
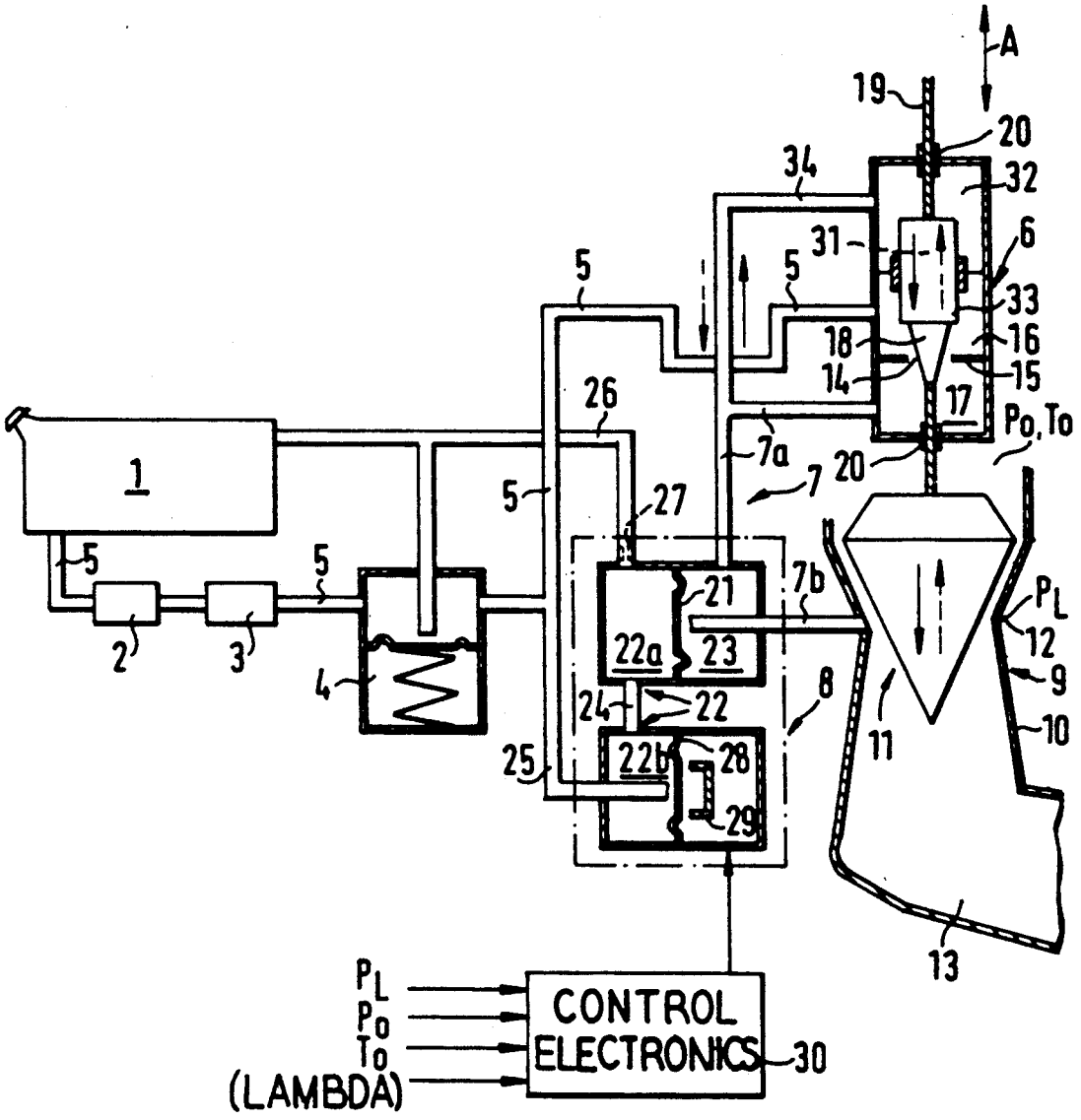
FIG. 1 is a diagram of a fuel/air-mixture-forming device with the device of the invention for correcting the composition of the mixture upon a change in the condition of load of the internalcombustion engine.

FIG. 1 shows a fuel tank 1 from which fuel is fed via a pump 2 through a filter 3 arranged behind it and a system pressure control 4 with pre-controlled constant pressure through a fuel delivery line 5 to a feed unit 6. From the latter the fuel passes into a first section 7*a* of another fuel conveyor line 7 which debouches into a feed controller 8. A second section 7*b* of the fuel delivery line 7 leads from the feed controller 8 to a convergent-divergent nozzle 9 which is formed by a nozzle member 10 which is not symmetric about its axis. A throttle element 11 of rotational symmetry is displaceable in the nozzle 9. The second section 7*b* of the fuel feed line 7 debouches into the nozzle 9 in the vicinity of the narrowest cross-section 12, the nozzle on its part debouching into an inlet pipe 13 of the combustion engine, which is not further shown.

The feed unit 6 is divided into two partial spaces 16 and 17 by a diaphragm 15 having an opening 14, the partial space 16 being connected with the fuel tank 1 via the fuel feed line 5 and the partial space 17 being connected with the nozzle 9 via the fuel feed line 7. Furthermore, the partial space 16 is connected via an opening 31 with an equalization space 32 which, in its turn, is connected via a branch line 34 to the first section 7*a* of the nozzle-side fuel delivery line 7. A feed member 18 which is developed as cone forms a structural unit with an equalization piston 33; the feed member 18 is in this connection movable in the direction of its axis of rotation perpendicular to the plane of the diaphragm into the diaphragm opening and out of it. Thereby, the position of the feed member 18 determines the remaining cross-section of passage of the fuel through the feed unit 6 while an equalization piston 33 which is also arranged symmetrically to the axis of rotation passes in sealing fashion to the opening 31.

The feed member 18 and the equalization piston 33 are connected with a shaft 19 and are mounted for longitudinal displacement in two supports 20 of the feed unit 6. The throttle element 11 is connected to the free end of the shaft 19. There is rotational symmetry to the feed member 18. As a result of the movement-locked connection, the movements of the throttle element 11, the feed member 18 and the equalization piston 33 are thus coupled. The axial path of the shaft 19 and thus of the throttle element 11, feed member 18 and equalization piston 33 correspond to the gas-pedal path indicated by the double-ended arrow A. Due to the equally directed, mechanical interconnection of feed member 18 and throttle member 11, a feeding movement with the shaft 19 in the direction of the inlet pipe 13 leads to a progressive intrusion of the feed member 8 into the diaphragm opening 14. This produces a reduction in the cross-section of the fuel passage. Similarly, a corresponding intrusion of the throttle member 11 into the nozzle 9 leads to a reduction in the cross-section of the air passage. The cross-sections of passage are, in this connection, so adapted to each other that, upon an unimpeded flow of the fuel line 7, proportional conditions result in the case of the feed member 18 and the throttle member 11 with respect to the passage of fuel and/or air.

From FIG. 1 it can be noted that the feed controller has, among other things, two fuel spaces 22 and 23 which are sealed off from each by a flexible membrane 21. The fuel space 22 is subdivided by a connecting line 24 to two partial spaces 22*a* and 22*b*. A branch line 25 which debouches in the partial space 22*b* is connected to the fuel delivery line 5 behind the system pressure controller 4 so that a part of the fuel then conveyed by the pump 2 is fed, via the branch line 25, into the fuel space 22. A return line 26 which leads to the tank 1 is connected with the partial space 22*a* of the fuel space 22. A fixed throttle 27, or constriction, is inserted in the return line 26 in the region of the blow-out from the partial space 22*a*.

The branch line 25 is conducted into the partial space 22*b* and terminates at a slight distance from the wall of the partial space which is opposite an entrance to the region and which is also developed as a flexible membrane 28. On the side of this membrane 28 facing away from the branch line 25, an electromagnet 29 is located and can be controlled via a control electronics 30 and on a basis of response of the flexible membrane 28 to a magnet. The magnet moves the membrane 28 to a greater or lesser extent away from the adjacent opening of the branch line 25 upon the application of a control current. The input of the fuel space 22 is thus provided with a movable throttle and the output of this fuel space with a fixed throttle 27.

The first section 7*a* of the fuel conveyor line 7 debouches into the fuel space 23 and it extends, corresponding to the development of the branch line 25 with the second section 7*b* of the fuel conveyor line 7, into the fuel space 23 to shortly in front of the flexible membrane 21. Between the latter and the facing inlet opening of the second section 7*b* of the fuel conveyor line 7, there is thus also formed a movable throttle. A throttling taking place there, however, on basis of the movable throttle associated with the partial space 22*b* and the different pressures which are established in this way in the partial space 22.

In the control electronics 30 instantaneous values, determined by recorders not shown in detail, with respect to the pressure $P_L$, the air in the narrowest cross-section of the nozzle 9, the surrounding pressure $P_o$ in front of the nozzle 9, and the surrounding temperature $T_o$ in front of the nozzle 9 results; these surrounding values $p_o$ and $T_o$ are, as a general rule, the bounding condition behind the air filter which is connected in front of the internal-combustion engine. In addition, the actual lambda value which is determined in known manner via a lambda probe can also be introduced into the control electronic.

Figure 2:
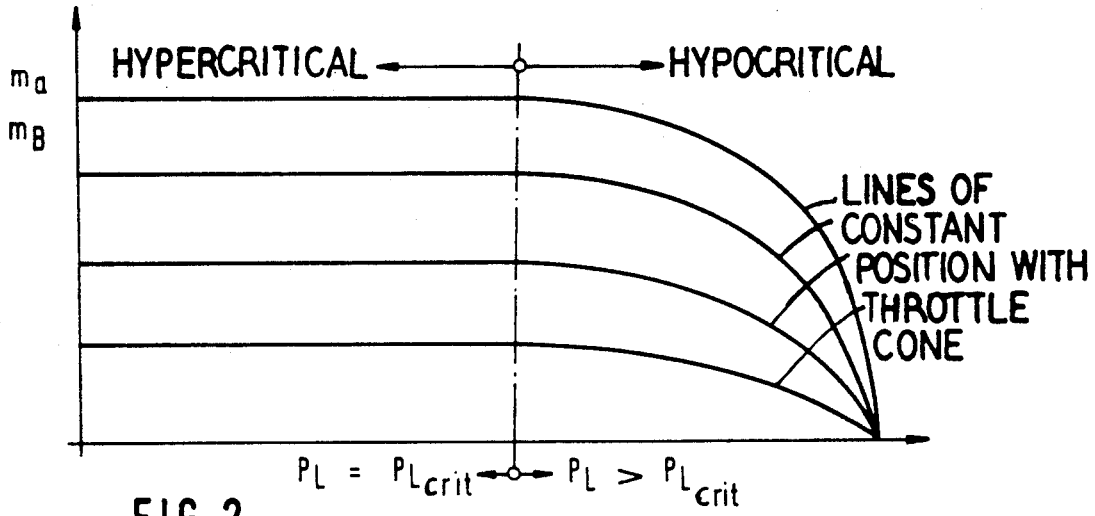
FIG. 2 is a graph showing the basic relationship of the mass flows of air and fuel forming the basis of the fuel/air-mixture-forming device.

FIG. 2 shows the relationships determined by experiment of air-mass flow $m_a$ and fuel-mass flow $m_B$ as a function of the pressure $P_L$ in the narrowest cross-section of the nozzle 9 for the hypercritical and hypocritical condition of flow. If the velocity of flow of the air in the narrowest cross-section of the nozzle reaches a velocity of sound in a given operating region of the internal-combustion engine, and the pressure of the air in the inlet pipe 13 of the engine drops below a "critical" value, no change takes place in the velocity of flow or in the state of the sir in the narrowest cross-section of the nozzle 9. Accordingly, the air-mass flow $m_a$ remains constant, with invariable position of the throttle element 11.

If a constant force-mass flow $m_B$ is fed to this constant air-mass flow $m_a$, then the composition of the resultant mixture, i.e. also the lambda value, remain constant and the pre-control of the fuel-air mixture is in this case invariable. In the basic diagram of FIG. 1 this means that in the hypercritical region, the control electronics 30 must act in a non-controlling manner; accordingly, no activation of the electromagnet 29 takes place by which constant flow conditions are established in the fuel space 22 and thus also the resilient membrane which is present between this fuel space and the fuel space 23 remains stationary and accordingly the fuel introduced into the feed unit by the system pressure controller 4 with constant forward pressure is conveyed with constant conditions of flow through the sections 7*a* and 7*b* of the fuel conveyor line 7 to the narrowest cross-section of the nozzle 9. A fundamental prerequisite for this uniform pre-control of the mixture is, as described above, that the effective cross-section of passage of the diaphragm 15 be proportional to the effective cross-section of the nozzle 9.

If, proceeding from the "critical condition of flow" described in the narrowest cross-section of the nozzle 9, the load on the engine is increased then, upon the exceeding of a given air pressure in the inlet pipe 13, the passage from critical flow with velocity of sound into a hypocritical flow with a subsonic velocity takes place. With unchanged position of the throttle member 11, the air-mass flow $m_a$ drawn in by the engine would thus be smaller and, with constant fuel-mass flow $m_B$ the mixture would be too rich and the lambda value decrease. In order that no deviation from the ideal pre-control takes place, with the natural consequences of a corresponding increase in the proportion of pollutants in the exhaust gas of the engine, the fuel-mass flow $m_B$ is reduced to the same extent as the air-mass flow $m_a$ decreases. The reduction in the fuel mass flow $m_B$ takes place via the control electronics 30 into which the pressure $P_L$ and also the pressure $p_o$ and the temperature $T_o$ are introduced as essential values.

The control electronics 30 activates the electromagnet 29 to attract the flexible membrane 28 to a greater or lesser extent, depending on the value of the control variable, and thus increases the passage gap accordingly between the open end of the branch line 25 and the membrane 28. This causes an increase in the fuel pressure in the plastic space 22 so that the flexible membrane 21 is moved towards the open end of the second section 7*b* of the fuel conveyor line 7, and thus the gap between the flexible membrane and this section 7*b* is reduced, with the result that less fuel can be conveyed through the pressure conveyance line 7.

Figure 3:
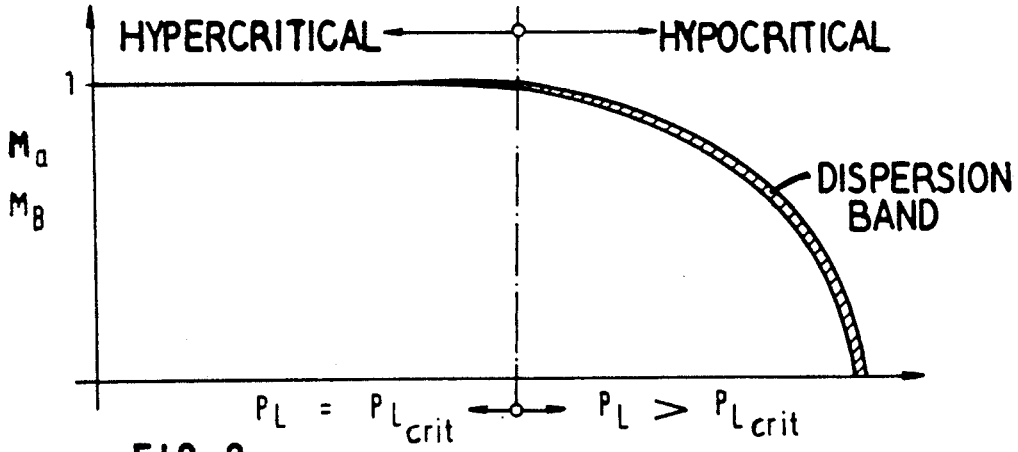
FIG. 3 is a graph similar to FIG. 2 with standardized showing of the mass flows of air and fuel.

FIG. 3 shows that with standardized presentation $M_a$ of the air-mass flow $m_a$ and of the standardized fuel-mass flow $M_B$ necessary for constant lambda value, the dispersion band for $M_a$ and $M_B$ for the entire operating range, i.e. for the pressure in the narrowest cross-section of the nozzle becomes narrow and therefore is still only slightly dependent on the position of the throttle member 11. Herein:

$$M_a = \left(\frac{m_a}{m_{a\,hypercrit.}}\right)_{yk=const.}$$

standardized air-mass flow in the position $y_k$ of the throttle cone.

-continued $$M_B = \left(\frac{m_B}{m_{Bhypercrit.}}\right)_{\substack{yk=const.\\ \lambda=const.}}$$ standardized fuel-mass flow in the position $y_k$ of the throttle cone for a predetermined lambda value.

FIG. 3 shows that in the entire hypercritical range $M_a=1$ and for constant lambda value $M_B=1$. For the hypocritical flow region, in view of $m_a<m_a$ hypercrit. and $m_B<m_B$ hypercrit. We also then have $M_a<1$ and $M_B<1$.

Deviations by the dispersion range around the ideal lambda value can be compensated for the lambda probe which cooperates with the control electronics 30. The smaller the dispersion range in different positions of the throttle element 11 and the better the pre-control—particularly in the hypocritical region—is carried out, the more the engagement of the lambda probe is relieved and the better the conversion of the pollutants in the exhaust gas so that the control of the fuel-mass flow in the hypocritical flow region can take place primarily on basis of the control variable of the pressure $P_L$ in the narrowest air cross-section.

In addition to the pre-control described above of the fuel/air mixture for the entire operating region of the engine, the particular development of the feed unit 6 with compensation piston 33 extending into the equalization space 32 and the connection via the branch line 34 to the first section *7a* of the nozzle-side fuel conveyor line 7 permits a correction of the composition of the mixture upon a change in the condition of load of the engine. Thus, upon a reduction in the inlet-pipe pressure at which fuel evaporates from the wall of the inlet pipe, the mixture is made leaner in front of the mixture-forming device in the manner that a movement of the gas pedal in the direction of reducing the amount of mixture leads to a corresponding movement of the feed member 18 and of the equalization piston 33 and the throttle member 11 in the direction of the arrow shown in solid line. As a result of this, due to the enlarging of the equalization space 32, a part of the fuel customarily conveyed into the fuel conveyor line *7b* is stored by the branch line 34 in the equalization space 32. In contradistinction to this, upon an enlargement of the inlet-pipe pressure and condensation of fuel from the mixture delivered from the mixture formation and deposited on the walls of the inlet pipe, an enrichment of the mixture delivered by the mixture-forming device takes place. The enrichment takes place in the manner that, upon the movement of the gas pedal in the direction of an enlargement of the amount of fuel-air mixture, the throttle element 11 and feed member 18 with the equalization piston 33 are moved in the opposite direction corresponding to the dashed line arrows so that, as a result of the reduction of the equalization space 32 which goes hand in hand with this, fuel, in addition, flows via the branch line 34 into the section *7b* of the fuel conveyor line 7.

In the following claims, certain ones of the reference numerals have been inserted to facilitate a reading of the claims, it being understood that the numerals are not intended to limit the claims.

I claim:

1. A system for a mixing device for correction the composition of a fuel-air mixture upon a change in state of load of an internal combustion engine having a fuel-air mixture device, comprising a fuel feed unit;

an inlet-side fuel feed line and an outlet-side fuel-feed line connected to the feed unit; and wherein the feed unit includes a movably mounted feed member which, as a function of its position, establishes variable fuel passage cross-sections in the feed unit;

the feed unit includes a movable equalization element and an opening which is closed in sealing manner by the equalization element, there being an equalization space connected to the opening and a branch line connecting the equalization space with the outlet-side fuel delivery line;

wherein the feed member and the equalization element are mechanically locked for movement with each other to provide a regulating function; and a movement of the feed member in a direction enlarging the fuel passage cross-section leads to a movement of the equalization element which reduces the equalization space, and a movement of the feed member in a direction reducing the fuel passage cross-section leads to a movement of the equalization member which enlarges the equalization space.

2. A system for a mixing device for correcting the composition of a fuel-air mixture according to claim 1, wherein the feed member and the equalization element form a unitary structural unit.

3. A system for a mixing device for correcting the composition of a fuel-air mixture according to claim 2, wherein the equalization element is an equalization piston, the latter passing through the opening.

4. A system for a mixing device for correcting the composition of a fuel-air mixture according to claim 1, wherein the equalization is an equalization piston, the latter passing through the opening.

5. A system for a mixing device for correcting the composition of a fuel-air mixture according to claim 4, wherein the feed unit comprises a diaphragm having an opening, and the feed unit is subdivided into a first and second partial space by the diaphragm, said first partial space being connected to the feed-side fuel-feed line, and said second partial space being connected to the discharge-side fuel line; and wherein a rate of fuel-air mixture flow is dependent on the position of the feed member in passing through the diaphragm opening, the first partial space being connected to the equalization space.

6. A system for a mixing device for correcting the composition of a fuel-air mixture according to claim 3, wherein the feed unit comprises a diaphragm having an opening, and the feed unit is subdivided into a first and second partial space by the diaphragm, said first partial space being connected to the feed-side fuel-feed line, and said second partial space being connected to the discharge-side fuel line; and wherein a rate of fuel-air mixture flow is dependent on the position of the feed member in passing through the diaphragm opening, the first partial space being connected to the equalization space.

7. A system for a mixing device for correcting the composition of a fuel-air mixture according to claim 1, wherein the feed member is formed as a cone.

8. A system for a mixing device for correcting the composition of a fuel-air mixture according to claim 1, further comprising a control member formed as a throttle element, and a nozzle body at an inlet pipe of the engine; and wherein the feed unit is connected in movement locked fashion with said throttle element, said throttle element having symmetry of revolution and being displaceable in the nozzle body which also has symmetry of revolution; and the throttle element and the nozzle body form a convergent-divergent nozzle, which debouches into the inlet pipe of the engine, the discharge-side fuel feed line debouching into the nozzle in or near to a narrowest cross-section of the nozzle.

9. A system for a mixing device for correcting the composition of a fuel-air mixture according to claim 1, wherein the equalization element comprises a bellows.

10. A system for a mixing device for correcting the composition of a fuel-air mixture according to claim 1, wherein the equalization element comprises a membrane.

* * * * *